United States Patent [19]

Otto

[11] Patent Number: 4,945,690

[45] Date of Patent: Aug. 7, 1990

[54] COVER MEMBER FOR RAIN GUTTERS

[76] Inventor: Edgar H. Otto, 45 Hillcrest Dr., Pinehurst, N.C. 28374

[21] Appl. No.: 348,031

[22] Filed: May 4, 1989

Related U.S. Application Data

[63] Continuation-in-part of Ser. No. 270,419, Nov. 9, 1988, which is a continuation of Ser. No. 204,534, Jun. 9, 1988.

[51] Int. Cl.[5] ..... E04D 13/00

[52] U.S. Cl. ..... 52/12; 210/477

[58] Field of Search ..... 52/12; 210/477

[56] References Cited

U.S. PATENT DOCUMENTS

| | | | |
|---|---|---|---|
| 2,175,521 | 10/1939 | Fry | 52/12 |
| 2,229,381 | 1/1941 | Grow | 52/12 |
| 2,284,440 | 5/1942 | Morrissey | 52/12 |
| 2,583,422 | 1/1952 | Haddon | 52/12 |
| 2,805,632 | 9/1957 | Coutare | 52/12 |
| 2,935,954 | 5/1960 | Matthews | 52/12 |
| 4,435,925 | 3/1984 | Jefferys | 52/12 |
| 4,467,570 | 8/1984 | Kriegel | 52/12 |
| 4,573,290 | 3/1986 | Fleming | 52/12 |
| 4,607,465 | 8/1986 | Hopkins | 52/12 |
| 4,796,390 | 1/1989 | Demartini | 52/12 |
| 4,841,686 | 1/1989 | Rees | 52/12 |

*Primary Examiner*—Henry E. Raduazo

[57] ABSTRACT

A cover member for mounting on a conventional rain gutter on a building structure, consisting of a one piece, thin longitudinal shield to be inserted under the shingles of the roof and having a serrated outer edge to rest snugly against and under the inside of the top lip of the gutter, the serrations providing small openings in front of this top lip of the gutter through which water from the roof can run into the gutter and exclude pine straw or leaves from entering the gutter. In one embodiment, the guard has a small upward crease in the longitudinal direction to add rigidity to the guard. In another embodiment, some of the tabs formed by the configuration of the notched edges are bent partially upward so as to sit on top of the gutter lip to support a snugger fit. After the shield is positioned, a block may be placed against the end of the shingle overhang and attached to the shield to block the shield in position.

4 Claims, 1 Drawing Sheet

COVER MEMBER FOR RAIN GUTTERS

This application is a continuation in part of my earlier application 07/270,419 filed 11/09/88, which in turn was a Continuation of application 07/204,534, filed 6/09/88 entitled Cover Member for Rain Gutters.

FIELD OF THE INVENTION

This invention relates to building structure rain gutter protectors intended to direct water runoff from the roof into such gutters while preventing pine straw, leaves and other debris from entering the gutter and thus clogging the downspouts.

DESCRIPTION OF THE PRIOR ART

In the past, various solutions have been proposed. For instance: (a) screen-like gutter inserts to cover the top of the gutter eventually collect pine straw and needles in their mesh, making it very difficult to clear, thereby clogging and defeating the purpose of the gutters. (b) Various deflector members have been proposed with the provision of some form of cover arched above the collection trough of the gutter system with a curved portion extending downwardly and reversely from the cover theoretically to cause water runoff to follow the contour of the cover and its arched portion into the trough area under the effect of surface tension, while the debris fails to cling to the cover contour. These designs fail to catch much of the water and heavy rain storms. (c) All of these past attempts have a common deficiency. They are too expensive to be commercially successful, since most homeowners are reluctant to spend much on gutters, and would rather go without gutters if they or the guards are two expensive.

SUMMARY OF THE INVENTION

In contrast, the present invention provides a simple, one-piece low cost cover member for original or retrofit use with conventional gutter structures, being invisible from the ground, and easily installed without the need of any tools. This simple cover guard is uniquely effective in preventing the entry of pine straw as well as leaves and other debris from entering the gutter. It will catch all the water in heavy rain storms. No separate fasteners, special mounting clips or attachment hinges are required.

DESCRIPTION OF THE PREFERRED EMBODIMENTS

Figure 1:
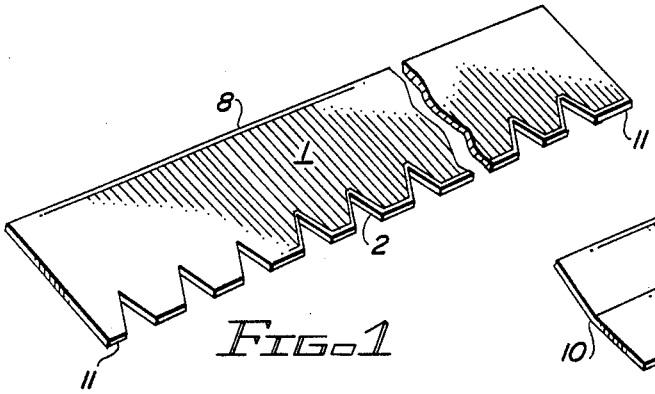
FIG. 1 is a perspective view of the single piece gutter guard made of material of sufficient thickness to give it rigidity.
Figure 2:
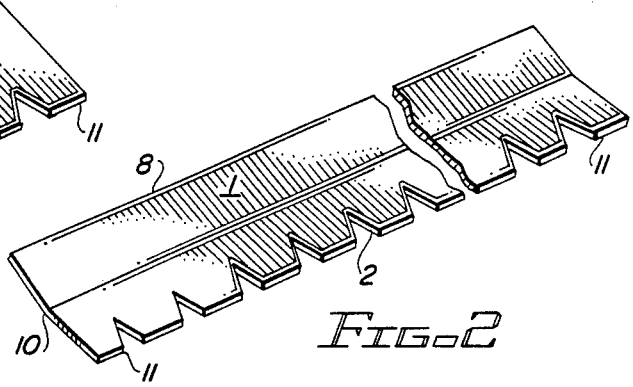
FIG. 2 is a perspective view of the single piece gutter guard with a longitudinal crease down the center to provide rigidity when made of thin material.
Figure 3:
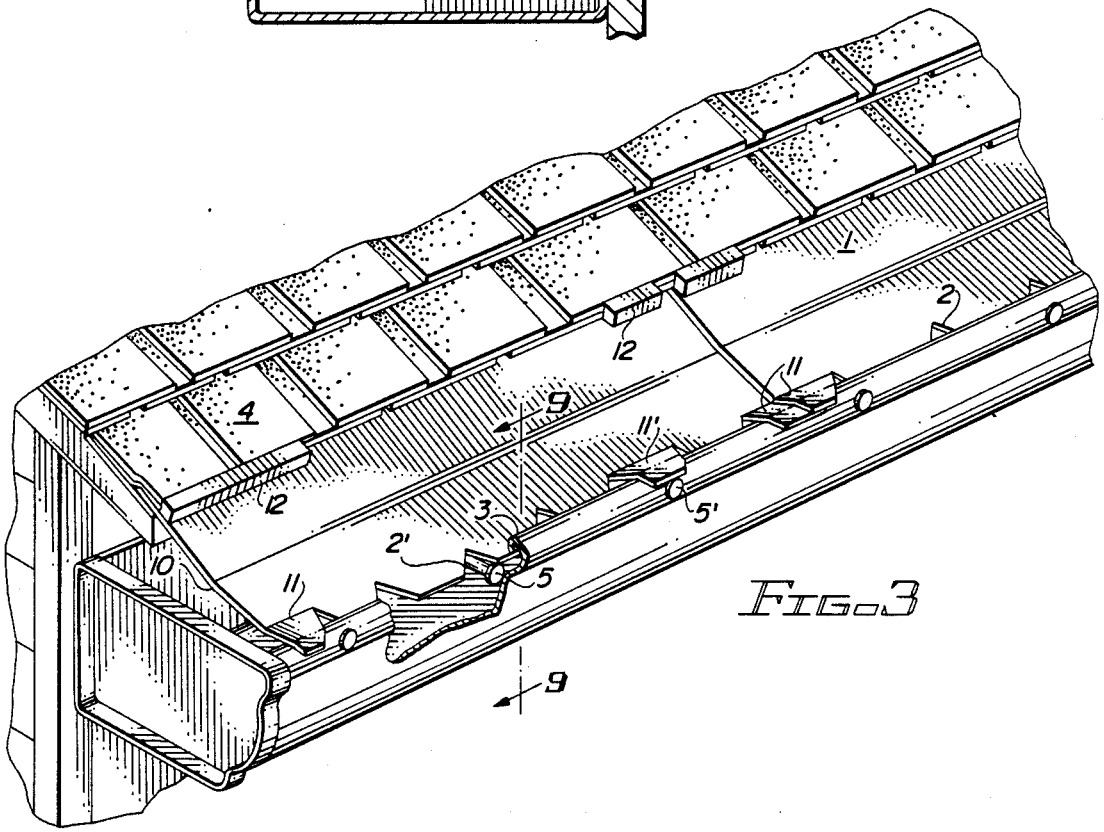
FIG. 3 is a perspective view of the gutter guard in FIG. 2 installed in a conventional gutter system on a building structure.

FIGS. 1 and 2 embody two versions of the single piece gutter guard. This guard is a thin, longitudinal strip 1 with one flat straight side 8, and with serrations or notches 2 as shown cut along the opposite side. This notched edge is fitted snugly against the outer top edge of the gutter 3 to provide openings for water to enter the gutter while excluding leaves and other debris. FIG. 3 shows how the gutter guard 1 from FIG. 2 is installed, simply by inserting it under the roof shingles 4 and pulling it snugly up against the top lip of the gutter 3. It shows how the notched edge of the guard 2' permits inserting it over the gutter support nails 5 when the gutter is attached to the structure in this manner. Where nails are used as shown, they provide additional support for the guard to hold it snugly against the top lip of the gutter 3. The small exposed openings 2 in the guard in the front of the top lip of the gutter 3 permit water to flow into the gutter while excluding pine straw, leaves and other debris.

If the guard is of thin strip metal, it may sag between nail supports and allow debris to be washed into the gutter. In this case the guard should have a slight longitudinal crease 10 as shown by FIG. 2 to give it rigidity. This is particularly important when no gutter support nails of the type shown are used to attach the gutter to the structure.

In order to further support the ends of the gutter shield pieces, and keep them snug, the end tabs 11 should be bent upward slightly when installing the shield so that the end tabs sit on top of the top lip of the gutter 3, as shown in FIG. 3.

To assure that the guard stays tight against the top lip 3 of the gutter, after the guard is positioned, a block 12 is attached to the top of the shield against the overhang of the roof shingles 4 by adhesive, thereby locking the shield into position.

Figure 4:
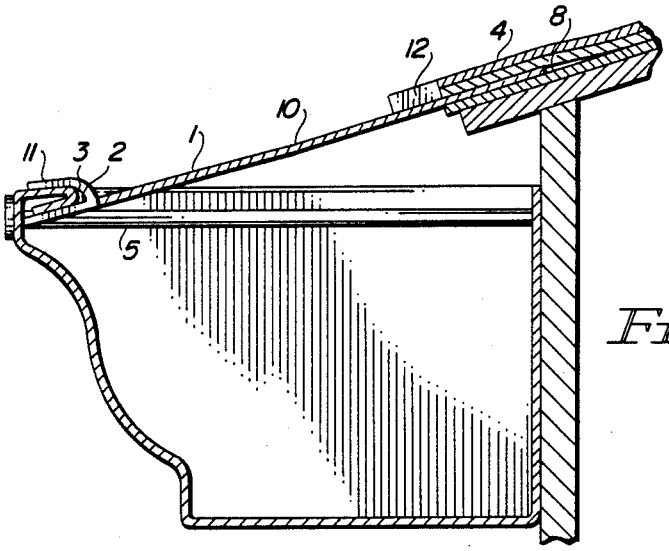
FIG. 4 is a vertical cross-sectional view of the structure of FIG. 3, taken along the line 9—9 thereof, which line cuts through the center of one of the notches which is not straddling one of the gutter support nails.

FIG. 4 is a cross sectional view 9—9 of FIG. 3 of the guard 1, showing how it fits under the roof shingles 4 and how the notch 2' straddles the gutter support nail 5, and how the turned up tab 11 at each end of the gutter rests on top of the gutter 3, thereby supporting the shield and keeping it snug against the top lip of the gutter 3. This top lip 3 thereby constitutes a dam which holds back the rain water as it runs off of the roof shingles 4, so as to divert it through the notches 2 into the gutter.

In those instances where the notch and nail do not match up, and where a tab like 11' falls on top of the guitar support rail, such tab would also be bent up to rest on top of the gutter outside lip 3.

FIG. 4 also shows how block 12, when placed against the overhanging end of the shingles 4, and attached by adhesive to the top of the shield 1, locks the shield into position.

I claim:

1. A gutter system, comprising in combination a conventional gutter having a predetermined width, an upper inwardly directed top lip, and means to secure said gutter to a building adjacent a shingled roof, said combination further comprising:

a gutter shield formed from a length of generally planar, imperforate, semi-rigid metallic or plastic strip material, dimentioned to span said predetermined width and having first and second sides, said shield having a first planar edge on said first side adapted to permit insertion beneath a row of shingles having a lower edge adjacent said gutter, and notches punched out along a second edge on said second side, with resultant intervening tabs between the notches, positioned to fit snugly against the said inwardly directed lip of said gutter, with the second notched edge pushing snugly upward and toward against the inside of the gutter under the said inwardly directed lip, whereby water is permitted to enter the gutter through notches while leaves and other debris are excluded therefrom.

2. A gutter system comprising in combination a conventional gutter having a predetermined width, an upper inwardly directed top lip, and means to secure said gutter to a building adjacent a shingled roof, said combination further comprising:

a gutter shield formed from a length of generally planar, imperforate semi-rigid metallic or plastic strip material dimentioned to span said width and having first and second sides, said shield having a predetermined length, a first planar edge on said first side adapted to permit insertion beneath a row of shingles having a lower edge adjacent said gutter and notches punched out along a second edge on said second side, said gutter shield having a longitudinal stiffening crease down the length of the shield, adapted to permit insertion snugly against and beneath the said inwardly directed top lip of the gutter, whereby water is permitted to enter through said notches while leaves and debris are excluded therefrom.

3. A gutter system comprising in combination a conventional gutter having a predetermined width, an upper inwardly directed top lip, and means to secure said gutter to a building adjacent a shingled roof, said combination further comprising:

a gutter shield adapted to be formed from a length of generally planar, imperforate, semi-rigid metallic or plastic strip material dimensioned to span said predetermined width and having first and second sides, said shield having a predetermined length, a first planar edge on said first side adapted to permit insertion beneath a row of shingles having a lower edge adjacent said gutter and notches punched out along a second edge on said second side with resultant intervening tabs running through its length, and characterized further in that the said tabs at each end and one in the middle of said predetermined length, are partially bent upward so as to sit atop of said inwardly directed top lip of the gutter, so as to hold the ends and center portion of the said predetermined length of the guard more snugly against and beneath said inwardly directed top lip of the gutter, whereby water is permitted to enter said gutter through notches while leaves and other debris are excluded therefrom.

4. A gutter system comprising in combination a conventional gutter having a predetermined width, an upper inwardly directed top lip, and means to secure all gutter to a building adjacent a shingled roof, said combination further comprising:

a gutter shield formed from a length of generally planar, imperforate, semi-rigid metallic or plastic strip material dimentioned to span said width and having first and second sides, said shield having a predetermined length, a first planar edge on said first side adapted to permit insertion beneath a row of shingles having a lower edge adjacent said gutter and a notched edge on said second side with resultant intervening tabs between said notches, positioned to fit snugly against the said inwardly directed lip of said gutter, with the second notched edge pushing snugly upward and forward against the inside of the gutter, and characterized further by a block adhesively attached to the top of said predetermined length of shield, and positioned tightly against the said lower edge of the overhang of the said row of shingles on a roof, thereby locking the shield into position, beneath said inwardly directed top lip of the gutter, whereby water is permitted to enter said gutter through said notches while leaves and other debris are excluded therefrom.

* * * * *